US007024776B2

(12) United States Patent
Wain

(10) Patent No.: US 7,024,776 B2
(45) Date of Patent: Apr. 11, 2006

(54) SAFETY RAZORS

(75) Inventor: Kevin J. Wain, Reading (GB)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 11/185,293

(22) Filed: Jul. 20, 2005

(65) Prior Publication Data

US 2005/0246899 A1 Nov. 10, 2005

Related U.S. Application Data

(63) Continuation of application No. 10/411,080, filed on Apr. 10, 2003, now abandoned, which is a continuation of application No. PCT/US01/31600, filed on Oct. 11, 2001.

(30) Foreign Application Priority Data

Oct. 16, 2000 (GB) ..... 0025336

(51) Int. Cl.
*B26B 21/02* (2006.01)

(52) U.S. Cl. ..... 30/50; 30/57; 30/527

(58) Field of Classification Search ..... 30/50, 30/57, 527

See application file for complete search history.

(56) References Cited

U.S. PATENT DOCUMENTS

| | | | | | |
|---|---|---|---|---|---|
| 1,975,757 | A * | 10/1934 | Gray | 30/50 |
| 2,691,217 | A * | 10/1954 | Clark | 30/50 |
| 3,593,416 | A * | 7/1971 | Edson | 30/50 |
| 4,403,412 | A * | 9/1983 | Trotta | 30/47 |
| 4,461,079 | A * | 7/1984 | Ciaffone et al. | 30/79 |
| 4,574,476 | A * | 3/1986 | Ortiz | 30/47 |
| 4,774,765 | A * | 10/1988 | Ferraro | 30/50 |
| 5,251,376 | A | 10/1993 | Althaus et al. | 30/50 |
| 5,313,706 | A * | 5/1994 | Motta et al. | 30/57 |
| 5,347,714 | A | 9/1994 | Prochaska | 30/41.5 |
| 5,402,574 | A | 4/1995 | Milner | 30/41.5 |
| 6,173,498 | B1 * | 1/2001 | Warrick et al. | 30/50 |
| 6,615,498 | B1 * | 9/2003 | King et al. | 30/527 |

FOREIGN PATENT DOCUMENTS

| | | |
|---|---|---|
| EP | 0 858 868 A1 | 8/1998 |
| EP | 0 858 869 A1 | 8/1998 |
| WO | WO 88/04980 | 7/1988 |
| WO | WO 97/726119 | 7/1997 |
| WO | WO 99/04938 | 2/1999 |

* cited by examiner

*Primary Examiner*—Kenneth E. Peterson
(74) *Attorney, Agent, or Firm*—Fish & Richardson P.C.

(57) ABSTRACT

A safety razor blade unit is provided including at least one blade with a sharp cutting edge extending lengthwise of the blade unit, the blade being carried by a blade assembly, a support structure to which the blade assembly is pivotally joined by a hinge running the length of the blade, the support structure including first spring elements, disposed along the length of the blade assembly, configured to resiliently oppose local deformation of the blade unit under shaving forces encountered in regions where the first spring elements act, and second spring elements, interposed between the support structure and blade assembly, configured to resiliently bias the blade assembly toward a normal position with respect to the support structure.

12 Claims, 12 Drawing Sheets

17
16
18
17
5
15
19
25
21
12
22
23
6
9
12
4
7
14
10
20
8

125
A
123a
118
116
105
123
104
126
136
134
138
130
102
112
101
132
108

123
105
136
118
138
130
136
112
138
134
135
101
108
132

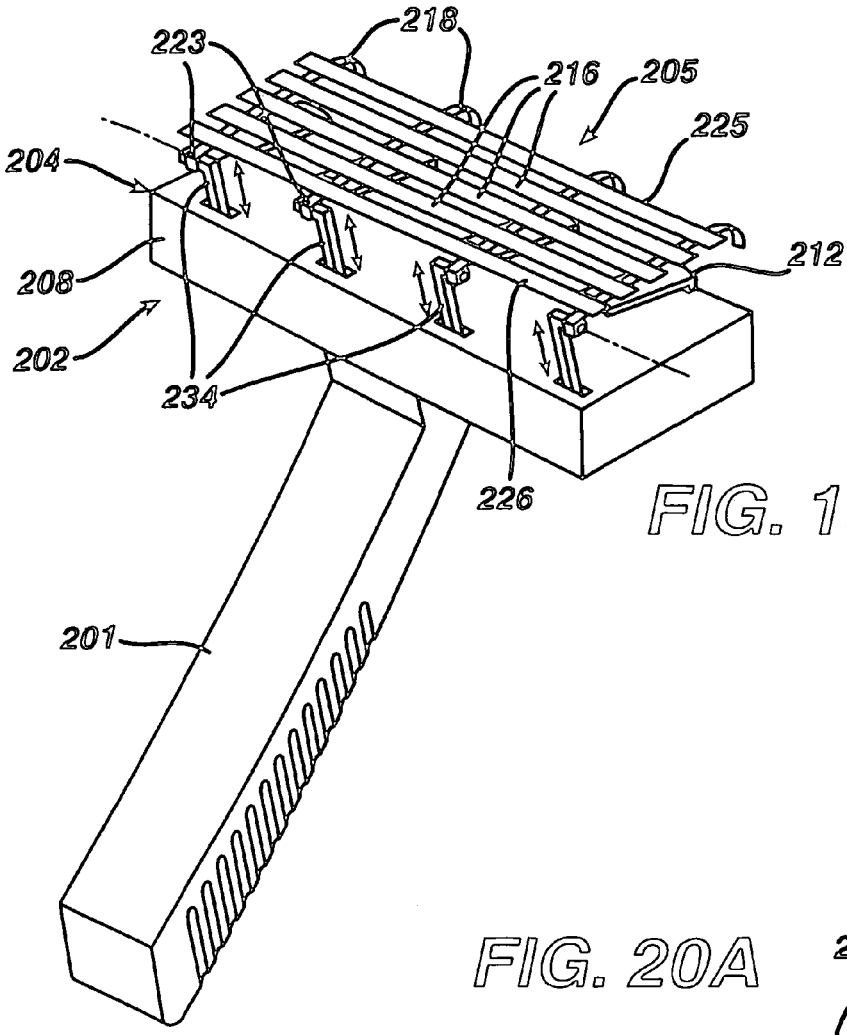
FIG. 19
FIG. 20A
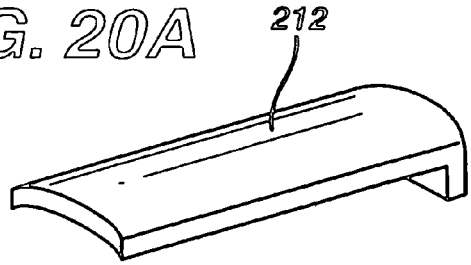
FIG. 20B
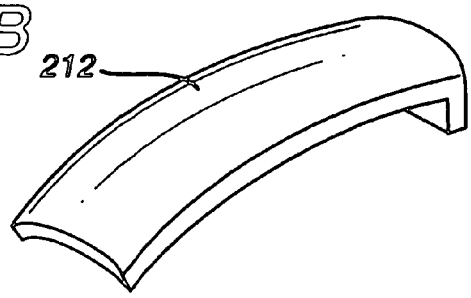

SAFETY RAZORS

CROSS REFERENCE TO RELATED APPLICATIONS

This application is a continuation, and claims the benefit of priority from U.S. patent application Ser. No. 10/411,080, filed Apr. 10, 2003 now abandoned, which is a continuation of PCT/US01/31600, filed Oct. 11, 2001, which claims priority from GB 0025336.9, filed Oct. 16, 2000, the contents of which is hereby incorporated by reference herein in its entirety.

TECHNICAL FIELD

This invention relates to safety razors.

BACKGROUND

This invention relates to safety razors of the kind in which a blade unit assembly is carried by a handle and includes at least one blade member with a cutting edge which is moved across the surface of the skin being shaved by means of the handle. A blade unit may be mounted detachably on a razor handle to enable the blade unit to be replaced by a fresh blade unit when the blade sharpness has diminished to an unsatisfactory level, or it may be fixedly attached to the handle with the intention that the entire razor be discarded when the blade or blades have become dulled. Detachable and replaceable blade units are commonly referred to as shaving cartridges.

There have been various proposals for mounting a blade unit on a handle to enable movement of the blade unit during shaving with the aim of maintaining conformity of the skin contacting parts with the skin surface during shaving. For example, many razors currently marketed have blade units which are pivotable about longitudinal axes extending parallel to the cutting edges of the elongate blades incorporated in the blade units. In WO 97/26119 and WO 99/04938, there are described safety razors with blade unit support structures which permit further freedom of movement of the rigid blade units relative to the razor handles. It has also been proposed to make the blade unit flexible between supporting points at its ends so that the cartridge can bow under shaving forces. WO 88/04980 describes another construction in which flexible blade elements are carried by a deformable foam block, but there is no separate handle as the razor is held by means of the foam block. In spite of these previous attempts, there remains a need for a safety razor with a blade unit which is able to conform closely to the skin contours during shaving.

SUMMARY

The present invention has for its object to fulfill the foregoing need and, in accordance with the invention, there is provided a safety razor blade unit comprising at least one blade with a sharp cutting edge extending lengthwise of the blade unit, and a support structure supporting the at least one blade, the support structure being resiliently compliant along the length of the blade unit under shaving forces imposed on the blade unit during shaving, the support structure including spring elements disposed along the blade unit to oppose local deformation of the blade unit under the shaving forces encountered in the regions where the spring elements act.

In a preferred embodiment, several spring elements are distributed along the blade unit, and each spring element is deformable in such a manner so that it exerts a substantially constant restoring force irrespective of the degree of deformation.

With such an assembly, the deformation of the blade unit under shaving forces can vary along the length of the blade unit enabling the blade unit to conform to skin undulations along the blade unit, with the forces exerted by the blade unit against the skin being substantially uniform along the blade unit. As a result. close conformity between the blade unit and the skin contours can be achieved without causing discomfort due to the blade unit being pressed against the skin under higher forces in certain confined areas.

Conveniently, the spring elements are so formed that they deform by buckling, and they may consist of webs of resiliently flexible material. Alternatively, the spring elements may comprise leaf springs, or other spring devices, which are capable of exerting a substantially constant force over the normal range of the blade unit deformation.

One form of safety razor blade unit according to the invention comprises at least one blade with a sharp cutting edge and a support structure supporting the at least one blade, the support structure having a blade platform structure carrying the at least one blade and having a front located forward of the at least one blade and a rear located behind the at least one blade, an intermediate structure, a base, a hinged connection between the intermediate structure and the front of the blade platform structure, the intermediate structure being movably mounted to the base to permit movement of the front of the blade platform structure towards and away from the base, and spring elements acting to urge the front of the blade platform structure away from the base and to urge the rear of the blade platform structure to rotate away from the base about the hinged connection, there being several spring elements disposed along the blade unit to act on respective portions of the blade platform structure being capable of displacement against the action of the spring elements unaccompanied by corresponding displacement of other portions of the blade platform structure.

A further aspect of the invention provides a safety razor blade unit comprising at least one blade with a sharp cutting edge, and a support structure supporting the at least one blade, the support structure having a blade platform structure carrying the at least one blade, a sub-frame, a base, the sub-frame having a forward edge hingedly connected to the blade platform forwardly of the at least one blade, and a rear edge hingedly connected to the base, and spring elements acting between the sub-frame and the blade platform structure and acting between the sub-frame and the base to urge the blade platform structure away from the base.

Several spring elements can be distributed along the blade unit and act between the sub-frame and respective portions of the blade platform structure. Also, several spring elements can be distributed along the blade unit and act between the base and respective portions of the sub-frame.

In a currently preferred embodiment, the support structure includes an upper frame on which the blade or blades are carried, and a sub-frame, with spring elements being interposed between the upper frame and the sub-frame. Conveniently, the support structure is formed by a unitary molding of a resiliently flexible material, such as rubber or rubber-like material, the spring elements then being integral with the upper frame and also being integral with the sub-frame of the blade unit. With the support structure formed as a unitary moulding, manufacture of the blade unit is facilitated as assembly of components is minimized. The upper frame is preferably hinged to the sub-frame at the front of the support structure, and, with a moulded construction, the connection between them can be conveniently provided by a living hinge. The hinged connection between the upper frame and the sub-frame is preferably displaceable downwardly, generally towards the handle, under load forces exerted on the upper frame near the front thereof. The sub-frame can be supported with respect to an underlying base in a manner permitting movement of the sub-frame towards the base against the action of suspension springs which can also be formed by webs of resiliently flexible material which deform by buckling so that a substantially constant return force is exerted on the sub-frame.

The upper frame can form a guard surface for contacting the skin ahead of the blades during a shaving stroke, and a cap surface for contact with the skin behind the blades. Alternatively, a separate guard element and/or a separate cap element could be mounted on the upper frame, although any such separate element would itself need to exhibit substantial flexibility along its length, or perhaps be divided up into short segments so as not to inhibit the flexing of upper frame to conform to the skin contours. One type of element which could, with advantage, be provided is a lubricating strip, which could be located adjacent the front or rear edges of the blade unit, such strips being adapted to deliver lubricant to the skin surface during shaving in a manner well known per se.

In another embodiment of the invention, the blade or blades are carried by an upper frame consisting of a series of independent upper frame members spaced apart along the blade unit and extending substantially perpendicular to the length of the blade unit, these upper frame members being acted upon by respective spring elements. The forward end of each upper frame member is mounted for movement against the action of the respective spring element about an axis extending lengthwise of the blade unit. The spring can act on an arm which is attached to and extends rearwardly from the forward end of the upper frame member so that this member is biased to an upper pivotal position. Conveniently, the spring urges a pin upwardly against the arm, the pin being guided for up and down movement with respect to a base frame, and the upper frame member can be pivotally mounted on a support post guided for up and down movement substantially parallel to the direction of pin movement, whereby the forward end of the upper frame member can move downwardly under shaving forces imposed on the blade unit against a restoring force exerted by the spring element.

Although the blade units of the invention may have a single blade, a plurality of blades, e.g. 2, 3, 4 or more blades, are preferably included and extend continuously along the blade unit with their sharpened edges substantially parallel. These blades are flexible for conforming to the skin contours. Another possibility is for several blade segments to be disposed along the blade unit so that they are able to move relative to each other as the upper frame flexes. To facilitate assembly of the blade unit the blades are preferably interconnected by transverse strips attached to the undersides of the blades, these strips and the blades together forming a flexible blade assembly in which, in an undeformed condition, the blades and strips are substantially coplanar to enhance the flexibility of the blade assembly. The blades are preferably as described in our British Patent Application No. 0025339.3 and the International Patent Application claiming priority therefrom.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 19 illustrates in perspective another embodiment of a safety razor having a blade unit in accordance with the invention;

FIGS. 20A and 20B show on an enlarged scale a leaf spring included in the blade unit of the razor shown in FIG. 19;

DETAILED DESCRIPTION

Figure 1:
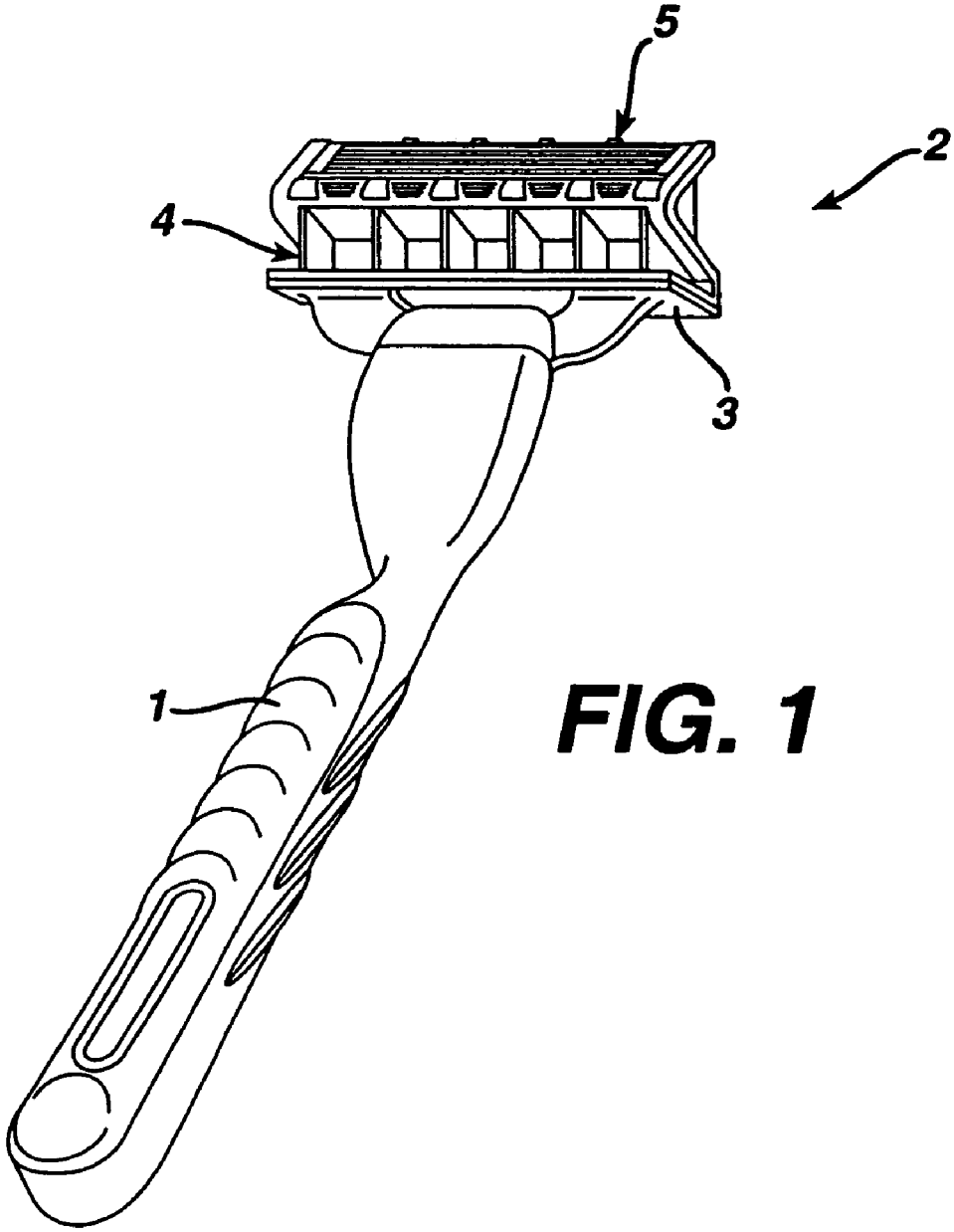
FIG. 1 shows in perspective a safety razor equipped with a blade unit in accordance with the invention in a front perspective view.
Figure 3:
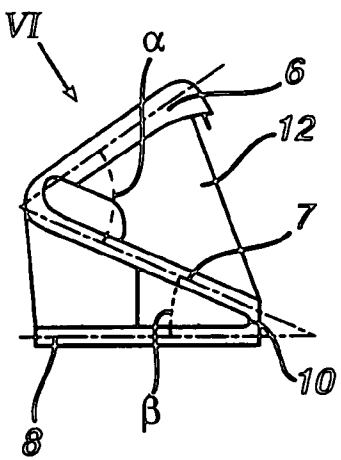
FIG. 3 is an end elevation of the blade unit.
Figure 2:
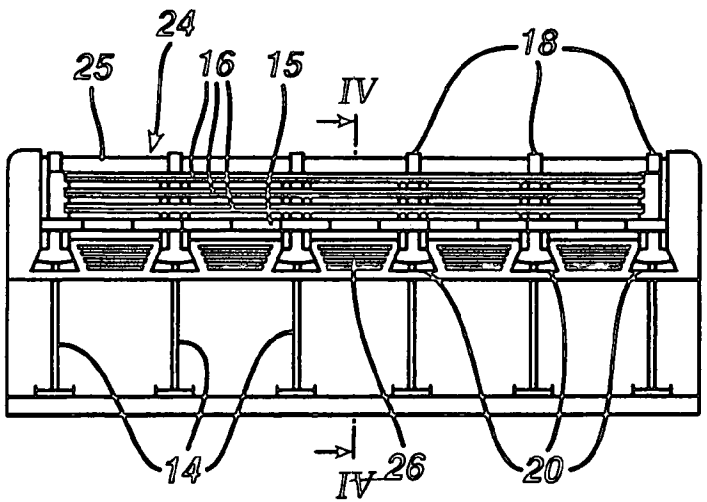
FIG. 2 is a front elevation of the blade unit of the razor shown in FIG. 1.
Figure 4:
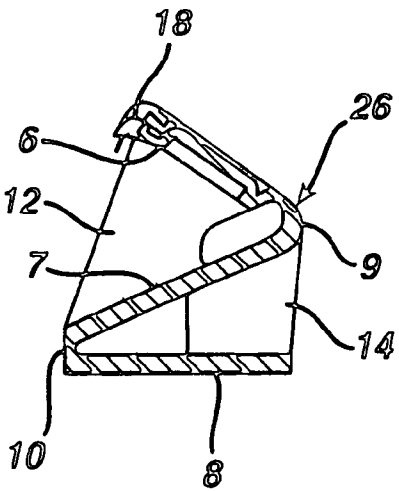
FIG. 4 is a cross-section taken along the line IV—IV in FIG. 2.
Figure 5:
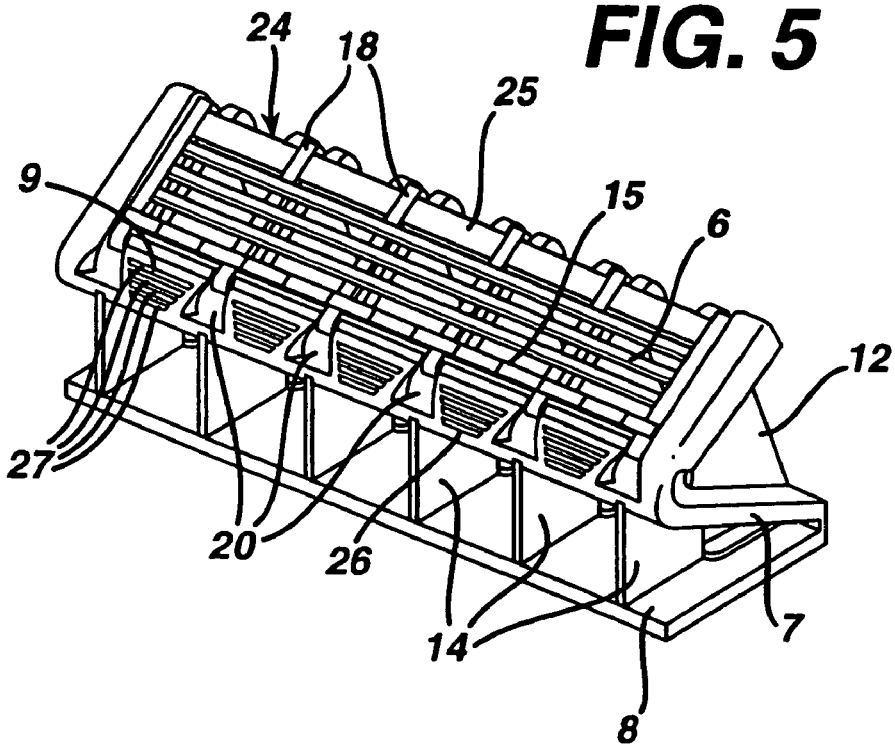
FIG. 5 is an isometric view of the blade unit.

The razor illustrated in FIGS. 1 to 11 has a handle 1 on which a blade unit 2 is mounted. As shown, the handle 1 has a fixed support platform 3 to which the blade unit 2 is securely fastened, but the blade unit could equally well be releasably connected to the handle 1 to allow replacement of the blade unit 2, The blade unit 2 comprises a support structure 4 on which a blade assembly 5 is carried. In the illustrated embodiment, the support structure 4 consists of a unitary moulding of rubber or a material having similar resiliently flexible properties to materials having appropriate characteristics include (i) Kraton G2705 having a hardness of 55 on the Shore A scale manufactured by the Shell Corporation, (ii) Evoprene #966 having a Shore A hardness value of 27 and distributed by Gary Chemical Corporation of Leominster, Mass., (iii) Santoprene 271-55 having a Shore A hardness value of 55 and manufactured by Advanced Elastomerics Corporation, and (iv) Santoprene 271-73 having a Shore A hardness value of 73 and also manufactured by Advanced Elastomerics Corporation.

The support structure 4 includes a blade platform structure formed by an upper frame 6 on the upper face of which the blade assembly 5 is positioned, a sub-frame 7 which has the form of a substantially planar sheet, and a base 8 which can also have the form of a substantially planar sheet. The upper frame 6 is hingedly connected to the sub-frame 7 at the front of the support structure 4, and in particular the upper frame 6 and sub-frame 7 are integral and are connected by a living hinge 9 at their forward edges. The upper frame 6 and the sub-frame 7 lie in first and second planes respectively, and are relatively positioned normally to diverge from each other rearwardly away from the hinge 9. The sub-frame 7 and the base 8 are hingedly connected at the rear of the support structure 4, and more especially the sub-frame 7 and base 8 are integrally connected by a living hinge 10 at their rear edges. The sub-frame 7 and base 8 are normally disposed to diverge from each other in the direction forwardly away from the hinge 10. With this configuration, the upper frame 6, sub-frame 7 and base 8, as viewed in end elevation (FIG. 3), or transverse cross-section (FIG. 4), define a Z shape, but with the angle a subtended between the upper frame 6 and the sub-frame 7 being greater than the angle P subtended between the sub-frame 7 and the base 8 so that the upper frame 6 is normally set at an appropriate angle with respect to the stem of the handle 1 and to ensure the desired deformation characteristics of the support structure as explained below. Several spring elements in the form of flexible webs of the handle 1 and to ensure the desired deformation characteristics of the support structure as explained below. Several spring elements in the form of flexible webs 12 are distributed along the blade unit 2. The flexible webs 12 extend between and are integrally interconnected with the upper frame 6 and the sub-frame 7, the flexible webs 12 being uniformly spaced apart along the support structure 4. As shown, there are six spring webs 12 although more or less than this number may be employed. The spring webs 12 normally lie in respective parallel planes perpendicular to the planes of the upper frame 6 and the sub-frame 7. The spring webs 12 constitute respective spring elements and each web 12 is capable of deforming by buckling, to allow the portion of the upper frame 6 in the region of that web 12 to be displaced towards the sub-frame 7 with the deformed or buckled web 12 exerting a substantially constant restoring force independent of the degree of buckling and hence the downward displacement of the upper frame 6. Since the spring webs 12 act independently of each other, different portions of the upper frame 6 along the length thereof may be readily displaced by different amounts towards the sub-frame 7.

The sub-frame 7 is similarly supported with respect to the base 8 by several suspension springs 14 distributed along the blade unit 2 between the sub-frame 7 and the base 8. These suspension springs are also formed by resiliently flexible webs integral with the sub-frame 7 and the base, there being six springs webs 14 uniformly spaced apart along the blade unit 2 in the illustrated embodiment. The spring webs 14 lie in respective planes perpendicular to the length of the blade unit 2 and, conveniently, the webs 14 are aligned and coplanar with the webs spring 12. The spring webs 14, which can also deform by buckling, serve as independent spring elements acting between the sub-frame 7 and the base 8, and they allow local displacement of the sub-frame 7 towards the base 8 and hence the handle 1, while exerting a substantially constant restoring force resisting such displacement. The resiliently flexible nature of the support structure with the springs webs 12,14 is such that localized portions of the upper frame 6 and the blade assembly 5 carried thereon can be deflected towards the razor handle 1 in order to adapt to the skin contours without necessarily influencing the, dispositions of other portions thereof, and the upper frame 6 and the blade assembly 5 can, as a consequence, contort to comply with the undulations of the skin area over which they are moving. Thus, the blade unit 2 is resiliently compliant to ensure close contact with the skin over the full area spanned by the blades.

Figure 8:
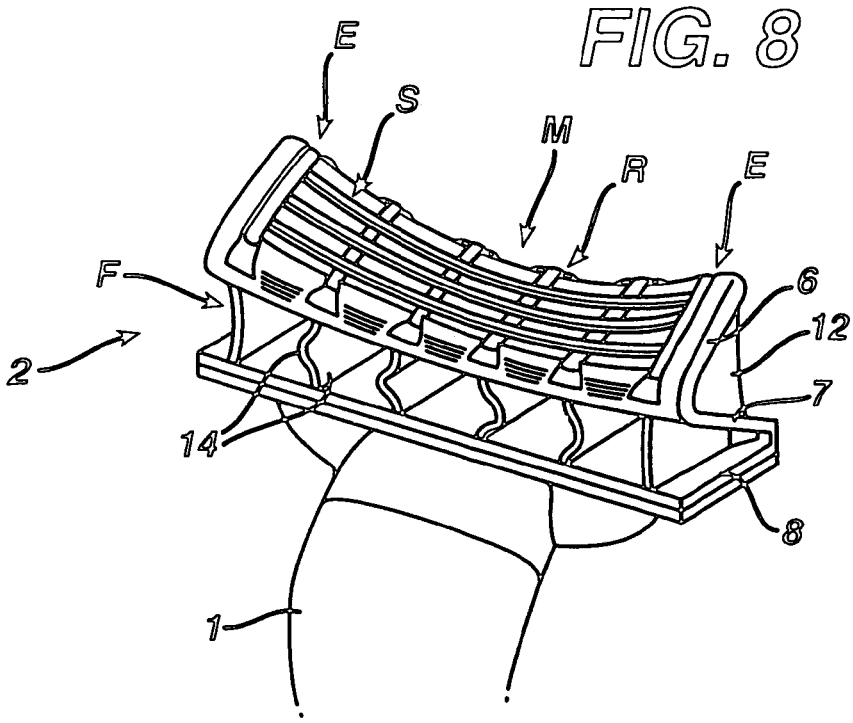
FIGS. 8 and 9 show the blade unit from the front and rear respectively, in a deformed condition as may arise during shaving.
Figure 9:
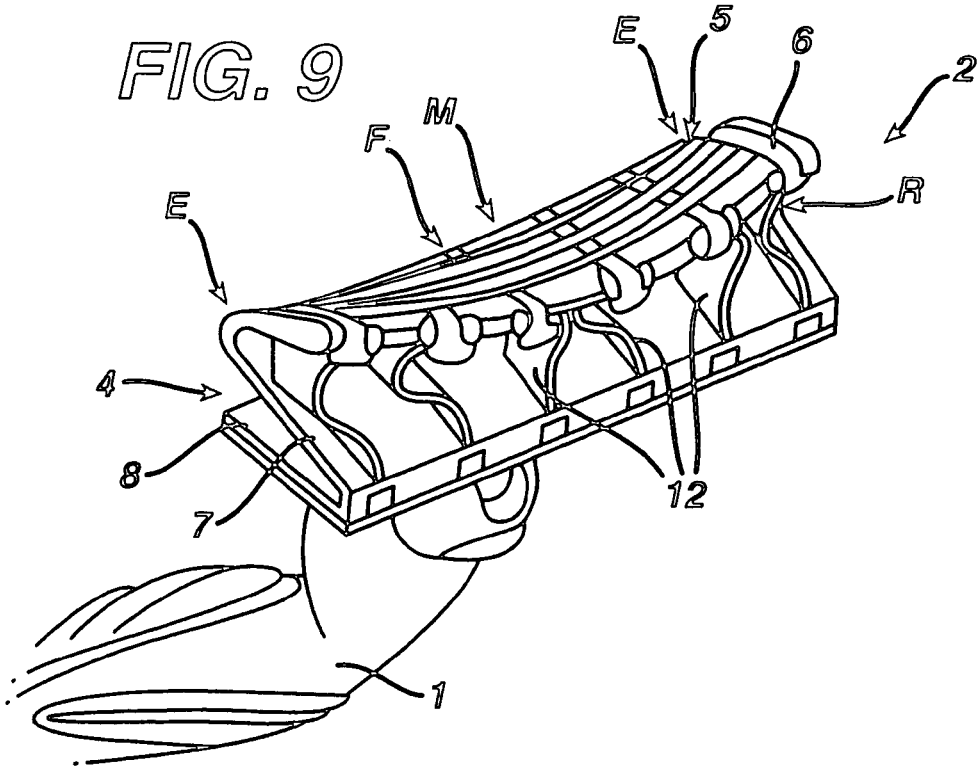
Figure 10:
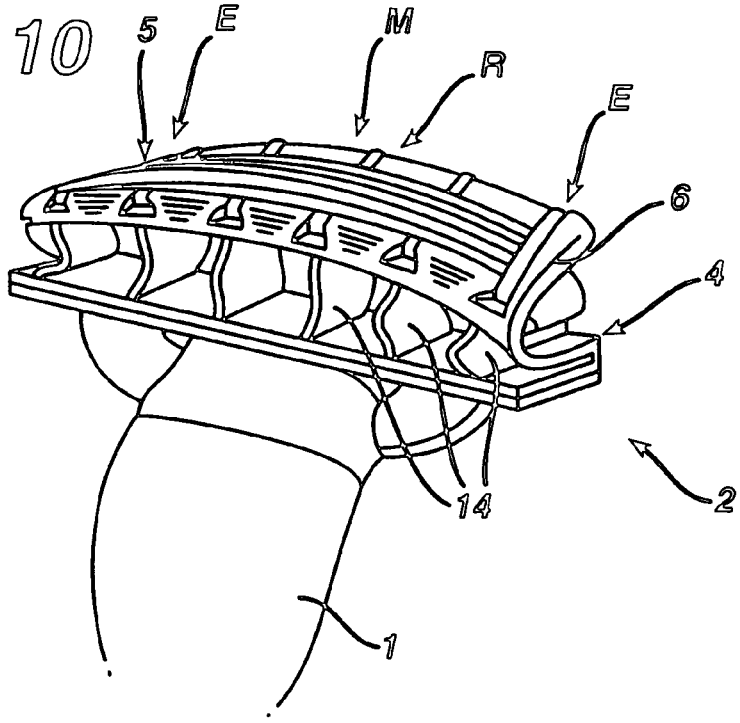
FIGS. 10 and 11 show the blade unit from the front and rear, respectively, in another deformed condition as may arise during shaving.
Figure 11:
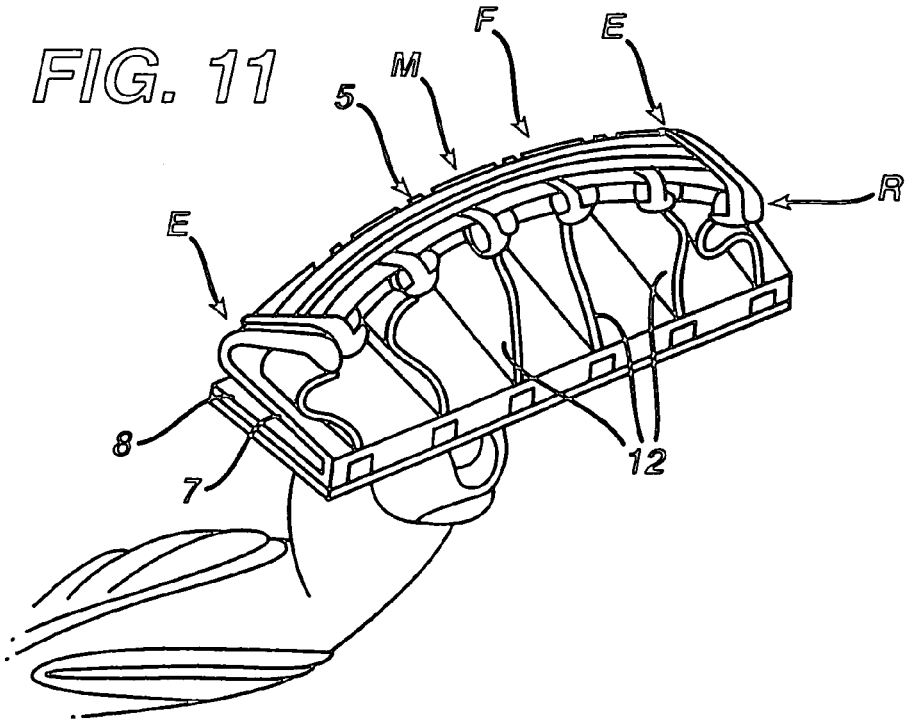

Thus, FIGS. 8 and 9 illustrate the blade unit 2 with the upper frame 6 and blade assembly 5 deformed into a concave form, their medial portions M being displaced towards the handle 1 by a greater amount than their end portions E with the spring webs 12,14 towards the centre M of the blade unit 2 being buckled to a greater extent than those webs 12,14 located nearer the ends of the blade unit 2. FIGS. 10 and 11 on the other hand show the blade unit 2 deformed into a convex configuration, the blade assembly 5 and upper frame 6 being displaced downwardly towards the handle 1 by a greater amount at the ends E of the blade unit 2 than at the central portion M of the blade unit 2, and, in this case, the spring webs 12,14 towards the ends of the blade unit being buckled more than those webs closer to the centre of the blade unit. Although both sets of webs 12,14 are shown buckled in FIGS. 8 to 11, this is not inevitable or essential. It is possible, for example as a result of downward shaving force applied towards the rear R of the blade unit, for the spring webs 12 to buckle so that the upper frame 6 and blade assembly 5 are displaced downwardly adjacent the rear edge R without the suspension spring webs 14 buckling and without any displacement of the upper frame 6 and the blade assembly 5 at their front edge F. Also a force applied near the front edge F can cause downward displacement of the upper frame 6 and blade assembly 5 at their front edge due to the suspension spring webs 14 buckling without the spring webs 12 becoming buckled. As a consequence, the upper frame 6 and blade assembly 5 are compliant both in the direction longitudinally of the blade unit 2 and in the direction perpendicular thereto in order to adapt to conform closely the contours of a skin area being shaved. Because the angle a subtended between the upper frame 6 and the sub-frame 7 is greater than the angle P subtended between the sub-frame 7 and the base 8, the spring webs 12 are somewhat longer and correspondingly weaker than the spring webs 14, whereby the spring webs 14 exert a greater resistance to downward displacement of the upper frame 6 and the blade assembly 5 at their front edge F than the resistance to downward displacement exerted by the spring webs 12 at the rear edge R of the upper frame 6 and blade assembly 5, which characteristic is considered desirable as during shaving greater forces are generally imparted to a blade unit in the region of the guard than those exerted in the region of the cap.

Figure 6:
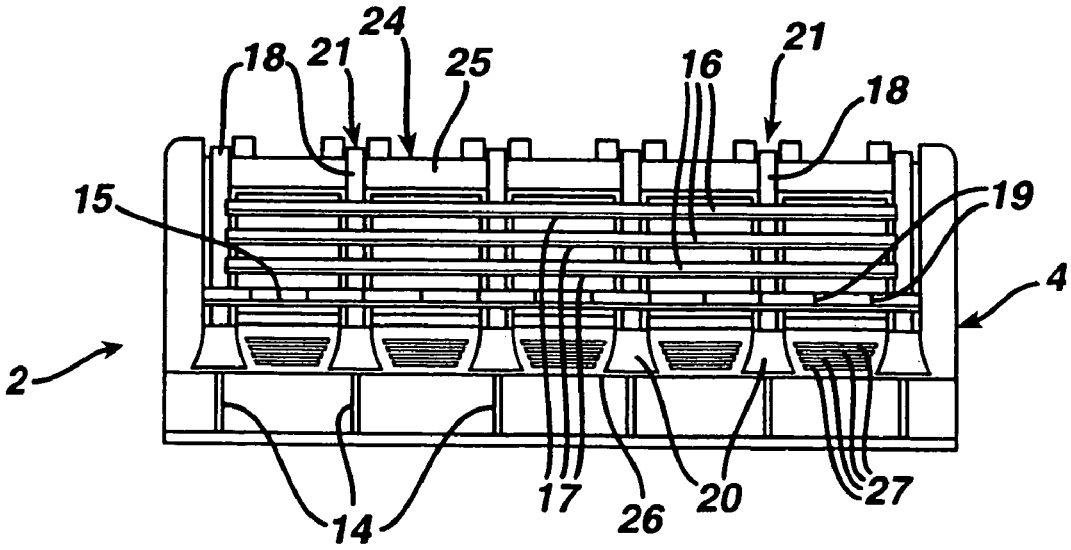
FIG. 6 is a view showing the blade unit as seen in the direction of the arrow VI in FIG. 3.
Figure 7:
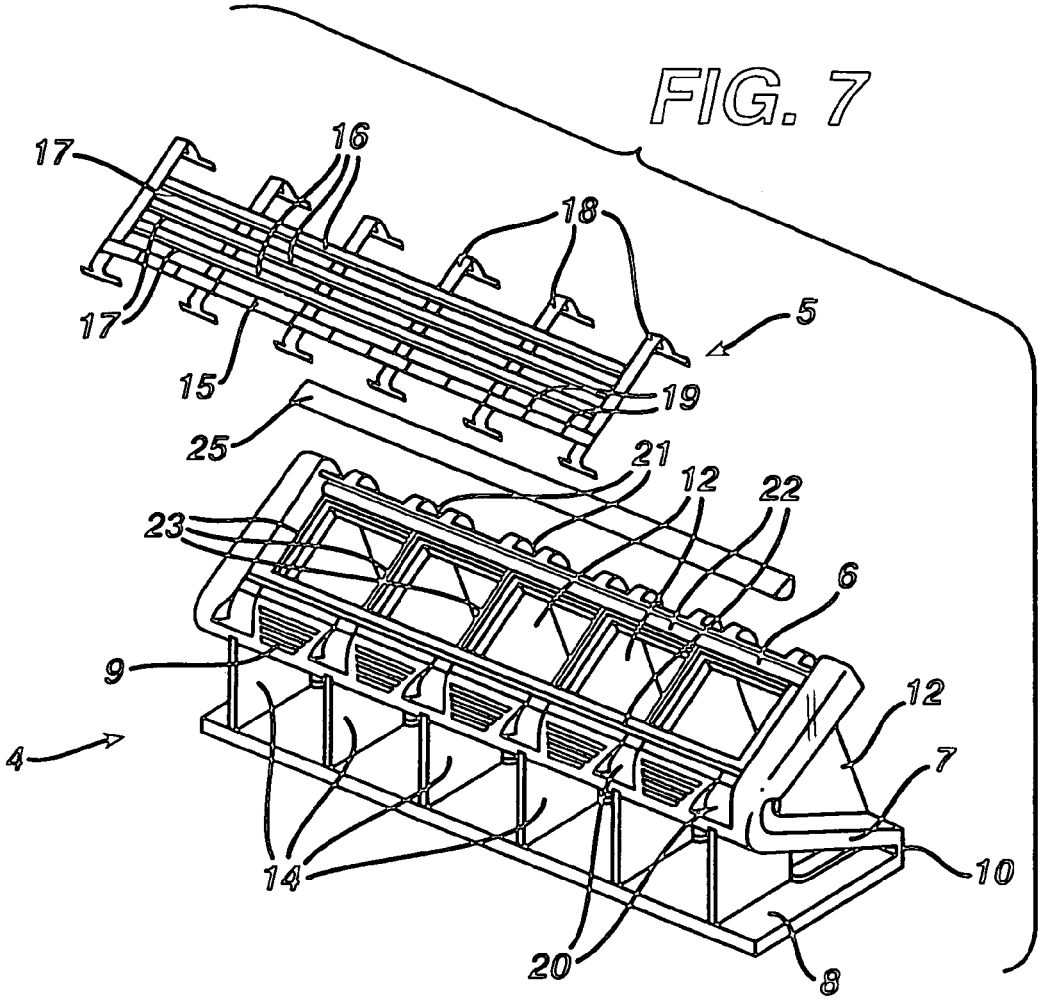
FIG. 7 is an exploded isometric view of the blade unit.

In the embodiment illustrated in FIGS. 1 to 11, the blade assembly 5 comprises a guard member 15 and a plurality of elongate blades 16, the guard member 15 and the blades 16 being formed by flexible strips of metal. The blades 16 have parallel forwardly facing sharpened edges 17. The guard member 15 and the blades 16 are interconnected by transverse strips 18 such as steel as used for the manufacture of blade in conventional blade units, which may be made of the same material as the blades 16, e.g. steel, and which attached to the undersides of the blades and guard member. Maximum flexibility of the blade unit is ensured by the blades 16 and transverse connecting strips 18 being coplanar in the normal, undeformed condition of the blade assembly and the blade unit. The guard member 15 is also substantially coplanar with the blades 16 and connecting strips 18 although as shown in FIGS. 6 and 7, the guard member has an upwardly inclined rear portion, and slits 19 are spaced along the length of this portion of the guard member 15 for enhanced flexibility of this member 15. Including the guard member 15 in the blade assembly 5 can be advantageous in reliably defining the shaving geometry of the blades, and the first blade in particular. The strips 18 have turned-down T-shaped ends which are engaged with notches 20,21 moulded in the front and rear edges of the upper frame 6 in order to secure the blade assembly 5 to the support structure 4. The upper frame 6 includes longitudinal front and rear frame members 22 and a series of transverse frame members 23 spaced along the blade unit 2 and substantially perpendicular to the length of the blade unit 2. The transverse frame members 23 are acted upon by respective spring elements and the upper edges of the spring webs 12 are attached to the respective frame members 23. In the assembled blade unit 2, the strips 18 of the blade assembly 5 extend above respective frame members 23. The cap 24 of the blade unit 2 includes a flexible lubricating strip 25 which sits in a groove extending along the rear longitudinal member 22 of the upper frame 6 and is held in place by the transverse strips 18 of the blade assembly 5. The support structure 4, at the front of the upper frame 6 in the region of its hinged connection to the sub-frame 7, forms a guard 26 which has longitudinal ribs 27 moulded thereon although protrusions of other configurations could be provided. Also, if preferred, a separate flexible guard element could be mounted on the support structure 4 and have a desired guard surface configuration.

Figure 12A:
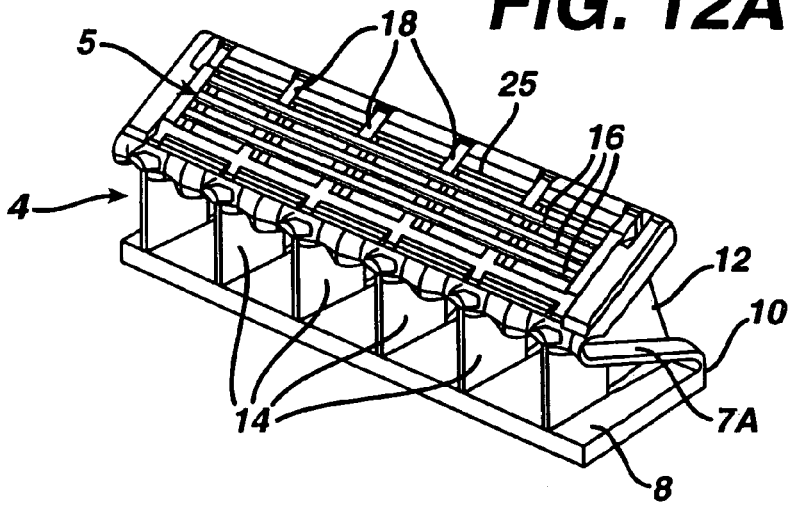
FIG. 12A is an isometric view from the front showing a blade unit as illustrated in FIGS. 1 to 11 but with a modified support structure.
Figure 12B:
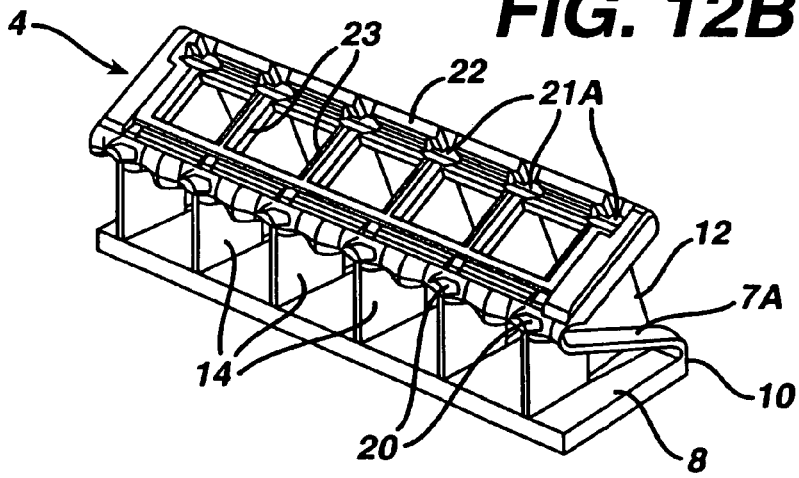
FIG. 12B is an isometric view of the support structure of the blade unit shown in FIG. 12A.
Figure 13:
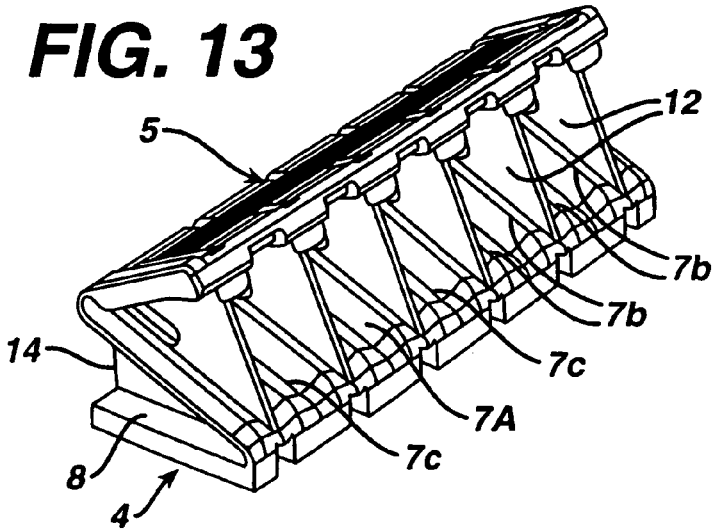
FIG. 13 is a rear isometric view of the blade unit shown in FIG. 12A.
Figure 14:
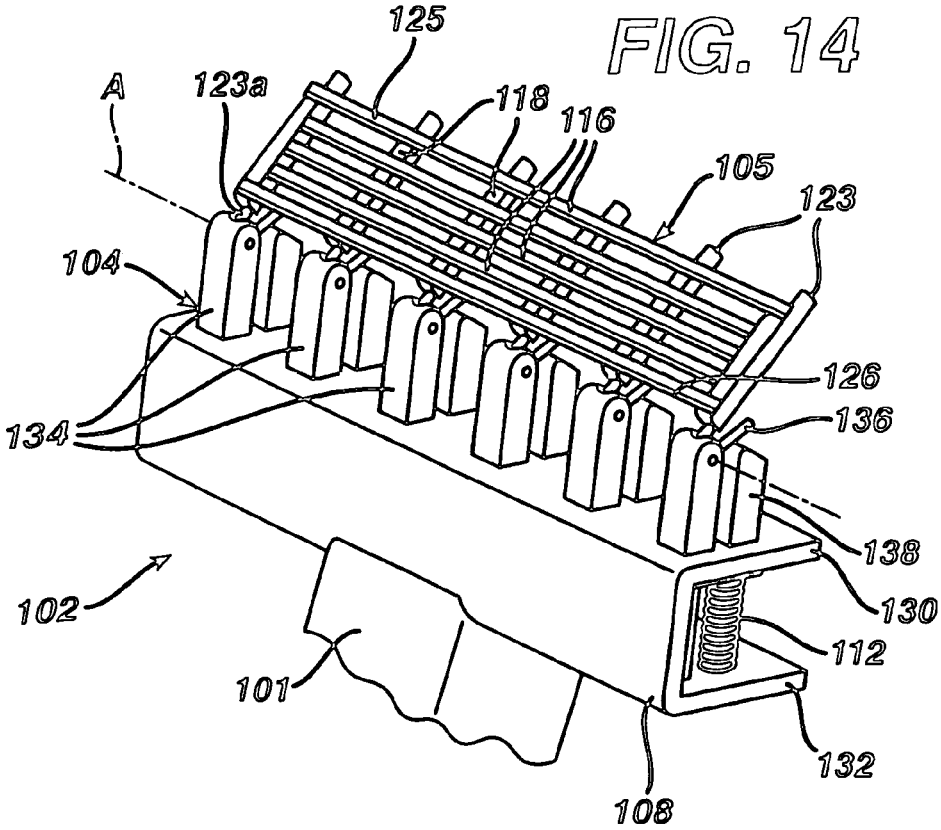
FIG. 14 is an isometric view showing from the front another safety razor with the blade unit embodying the invention.
Figure 15:
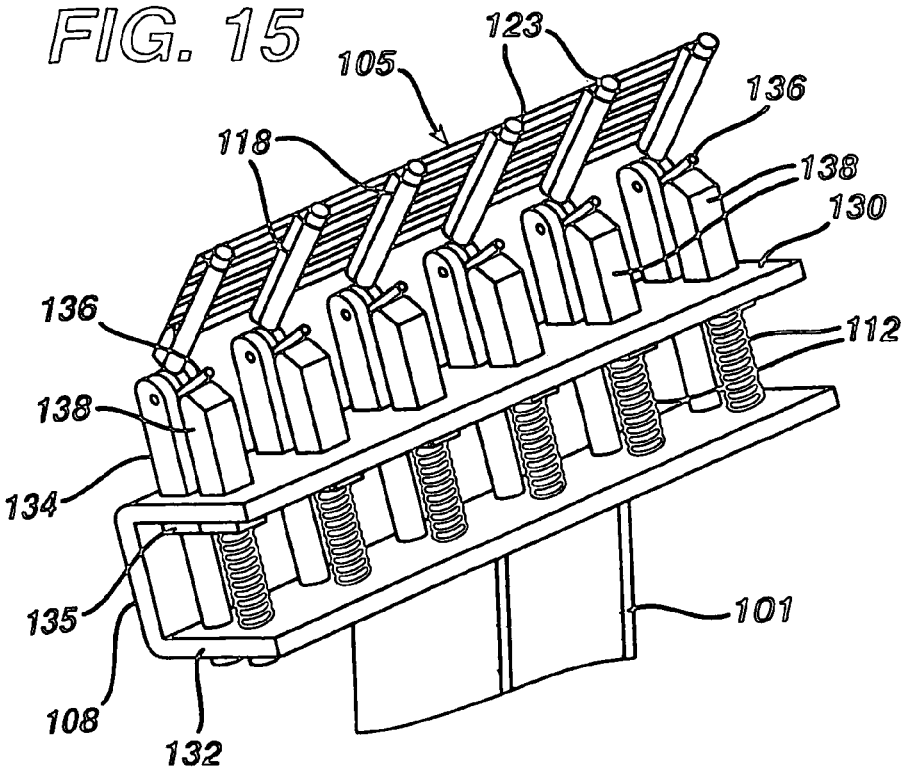
FIG. 15 is an isometric view showing the blade unit of the safety razor of FIG. 14 from the rear.
Figure 18:
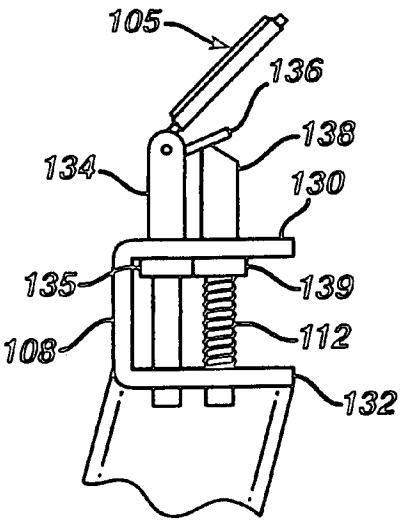
FIG. 18 is an end elevation of the blade unit of FIGS. 14 and 15.
Figure 17:
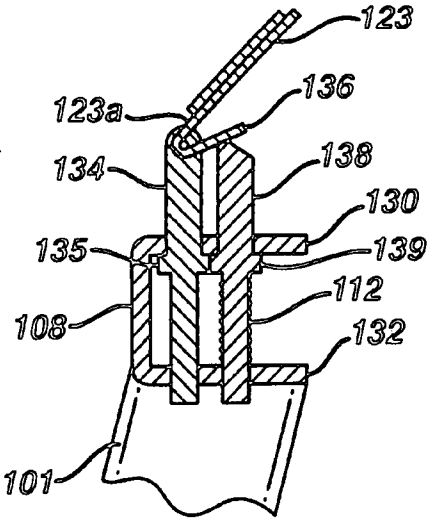
FIG. 17 is a cross-section taken along the line XVII—XVII in FIG. 16.
Figure 16:
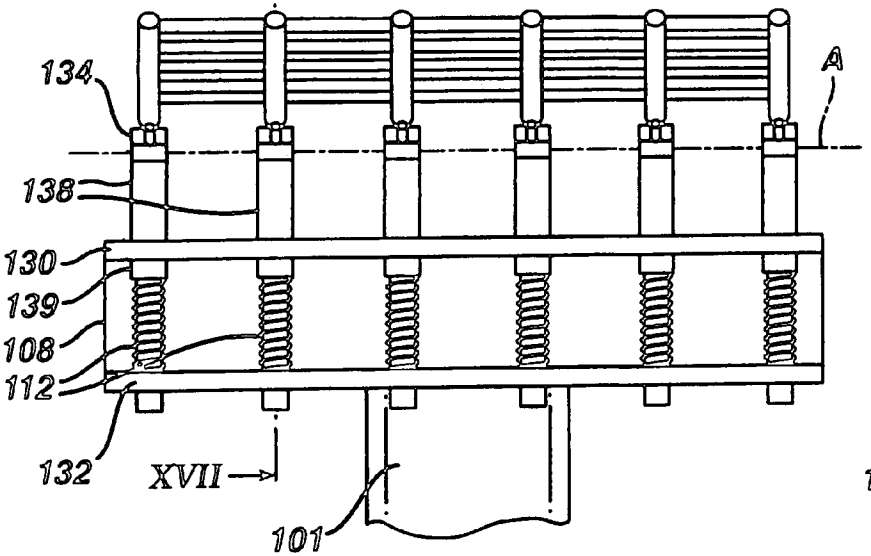
FIG. 16 is a rear elevation of the blade unit of the razor of FIGS. 14 and 15.
Figure 21:
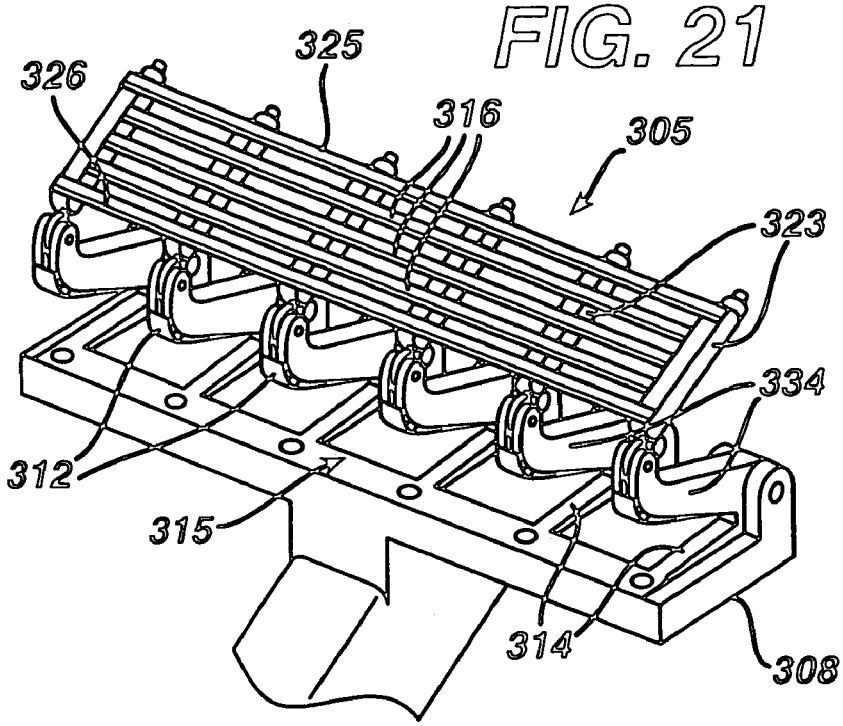
FIG. 21 is an isometric view illustrating a further embodiment of a safety razor with a blade unit according to the invention.
Figure 22:
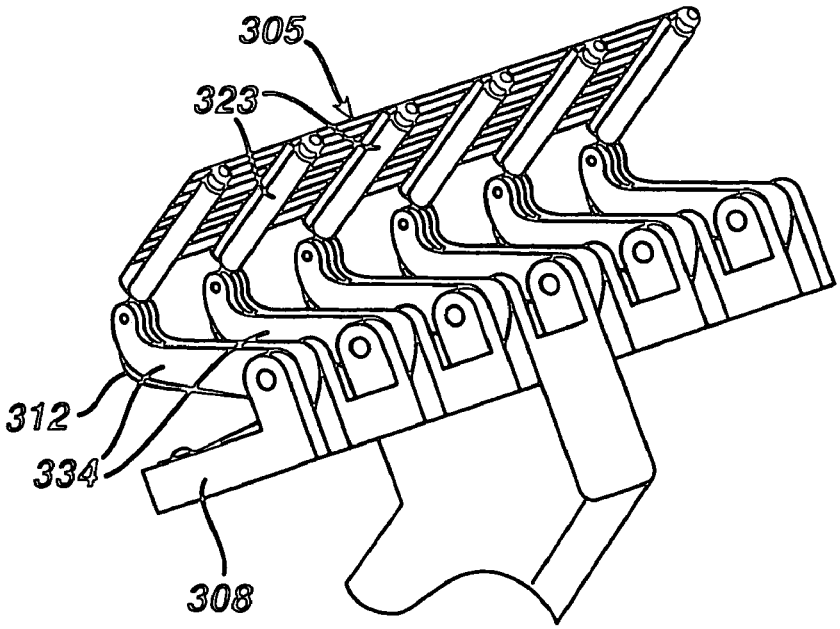
FIG. 22 is a rear isometric view of the razor of FIG. 21.
Figure 23:
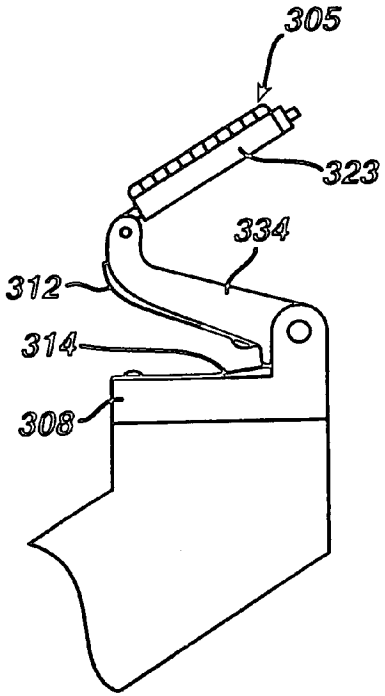
FIG. 23 is an end view of the razor shown in FIG. 21.
Figure 24:
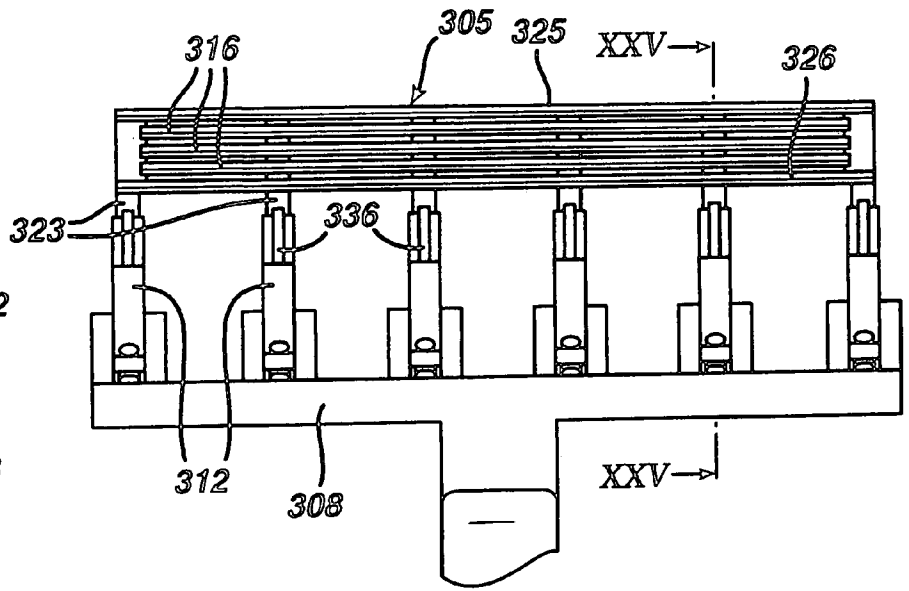
FIG. 24 is a front elevation of the razor shown in FIGS. 21–23.
Figure 25:
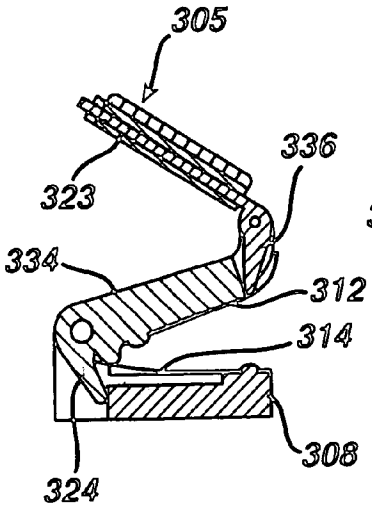
FIG. 25 is a cross-section taken along the line XXV—XXV in FIG. 24.

The modified safety razor blade unit shown in FIGS. 12A, 12B and 13 is for the most part the same as that described above with reference to FIGS. 1 to 11. However, in this embodiment, the sub-frame 7A has the form of a corrugated sheet rather than a substantially planar sheet. The corrugations which are only shallow and have their ridges 7*b* and valleys 7*c* directed parallel to the planes of the spring webs 12,14, serve to increase the flexibility of the sub-frame in the longitudinal direction of the blade unit 2. Another difference is that, in place of the notches 21 for securing the trailing ends of the blade carrying strips 18, through holes 21A are provided in the rear longitudinal frame member 22, the ends of the strips 18 being inserted through the respective holes 21A to ensure a secure connection between the blade assembly 5 and the unitary support structure 4.

In FIGS. 14 to 18, there is illustrated an embodiment in which the safety razor has a blade unit 102 mounted on a handle 101, the blade unit 102 including a flexible blade assembly 105 carried by a compliant support structure 104. The blade assembly 105 includes flexible strip blades 116 interconnected by transverse strips 118 attached to the undersides of the blades 116, as well as a flexible guard bar 126 and a flexible cap bar 125 respectively carried on the transverse strips 18 in front of and behind the blades 116. The support structure 104 has a base frame 108 shown U-shaped in cross-section with upper and lower platforms 130,132. A series of upwardly extending support members in the form of posts 134 are spaced apart along the base frame 108 and are slidably guided for up and down movement in holes formed in the upper and lower platforms. The posts 134 project above the upper platform 130 and have enlargements or abutments 135 which engage the underside of the upper platform 130 to limit their upward displacement. Mounted pivotally on the upper ends of the support posts 134, for pivotal movement about an axis A directed longitudinally of the blade unit 102, are respective upper frame members 123, these frame members 123 being normally arranged to extend upwardly and rearwardly from their forward ends 123*a* which are connected to the support posts 134. The down-turned ends of the transverse strips 118 of the blade assembly are engaged with the respective upper frame members 123. The forward 123*a* end of each upper frame member 123 is bent through nearly 180' and extended to form a rearwardly directed arm 136, and a pin 138, which like the posts 134 is guided in holes in the upper and lower platforms 130, 132 of the base frame 108, bears against the arm 136 to urge the upper frame member 123 to an upper pivotal position. Each of the pins 138 is pushed upwardly by a coil spring 112 which surrounds the pin 138 between the lower platform 132 and an abutment flange 139 on the pin 138. The abutment flange 139 also serves to limit the upward movement of the pin 138 by engaging the underside of the upper platform 130. The springs 112 also act to bias the support posts 134 to their uppermost positions so that the normal position of the support structure 104 and blade assembly 105 is as illustrated in the drawings. However, the upper frame members 123 are moveable independently of each other, as are their respective support posts 134, and this, in conjunction with the flexibility of the blade assembly 105, means that the blade unit 102, is resiliently compliant to enable close conformity with the skin contours during shaving. To further enhance the compliant characteristic of the blade unit 102 the upper frame members 123 can themselves be resiliently flexible. The arrangement of the restoring springs 112 to resist the deformation of blade unit under shaving forces is such that there is a substantially uniform force exerted by the blade unit against the skin irrespective of the degree of blade unit deformation over the area of contact with the skin.

The embodiment of the razor illustrated in FIGS. 19 and 20 is basically similar to that of FIGS. 12 to 16. The blade unit 202, which is mounted on the razor handle 201, includes a blade assembly 205 carried on a support structure 204 including a base frame 208 and upwardly projecting support posts 234 guided for up and down sliding movement relative to the base frame 208. Upper frame members 223 are, in this case, constituted by the transverse strips 218 which interconnect the blades 216 and support the flexible guard and cap bars 226, 225, although separate frame members could be provided. The upper frame members 223 have their forward ends pivoted on the upper ends of the post 234. Respective spring elements in the form of leaf springs 212 are mounted on the base frame 208 adjacent the rear edge and extend forwardly and upwardly for the free ends of the springs 212 to act on the upper frame members 223. As demonstrated by FIGS. 20A and 20B which depict one of the springs 212 in an unstressed and a stressed condition, respectively, the springs 212 are arcuate in cross-section. The effect of this spring configuration is that the spring tends 212 to flatten as it is deformed due to downward pivotal movement and/or displacement of the associated upper frame member 223, and, in this way, the spring 212 exerts a substantially constant return force irrespective of the deformation of the blade unit 202 during shaving.

The razor illustrated in FIGS. 21 to 25 is generally similar to that of FIGS. 19 and 20, but differs in that in place of the support posts 234, pivotal support arms 334 with lower rear ends pivotally connected to the base frame 308 are provided to mount the upper frame members 323 on which is carried the blade assembly 305 including the parallel blades 316, the flexible guard bar 326 and the flexible cap bars 325. First spring elements consisting of leaf springs 312 are mounted on the support arms 334 and act on extension fingers 336 of the upper frame members 323 to bias the upper frame members 323 to an uppermost pivotal position, and second spring elements 314, which are formed by respective leaf spring arms 314 of a common comb-shaped leaf spring 315 mounted on the base frame 308, act with their free ends against the undersides of the support arms 334. The leaf spring elements 314 are strongly pre-tensioned so that the forces exerted on the respective support arms 334 do not increase significantly as the support arms are pivoted downwardly by shaving forces imparted against the upper face of the blade unit in use of the razor, the upward pivotal movement of the arms 323 being limited by fingers 324 thereon abutting against the base structure 308 as may be seen in FIG. 25. The upward pivotal movement of the anus 323 is similarly limited by the fingers 336 abutting the arms 334. As in the previous embodiments, the blades 316 and the blade assembly 305 as a whole are flexible, so that, with independently supported upper frame members 323, the blade unit 302 is resiliently compliant over the full area of its contact with the skin during shaving.

Other support structure arrangements and modifications to the specifically described embodiments are possible without departing from the principles of the invention and will occur to those skilled in the art. Merely by way of example, it is mentioned that the pivotal mountings and associated leaf springs 312, 314 between the pivotal support arms 334 and the base frame 308 and/or between the pivotal support arms 334 and the upper frame members 323 in the embodiment shown in FIGS. 21 to 25 could be replaced by living hinges. It is to be understood, therefore, that the embodiments specifically described above are given by way of non-limiting example only and it is the intention that the scope of the invention should be limited only by the claims which follow.

What is claimed is:

1. A safety razor blade unit comprising at least one blade with a sharp cutting edge extending lengthwise of the blade unit, the blade being carried by a blade assembly, a sub-frame (support structure) to which the blade assembly is pivotally joined by a hinge running the length of the blade, the sub-frame (support structure) including first spring elements, disposed along the length of and between the blade assembly and the sub-frame, said first spring elements being configured to resiliently oppose local deformation of the blade unit under shaving forces encountered in regions where the first spring elements act, said sub-frame being pivotally joined to a base, said base having (and) second spring elements disposed along the length of and (,) interposed between the sub-frame (support structure) and base (blade assembly), said second spring elements being configured to resiliently bias the blade assembly toward a normal position with respect to the base (support structure).

2. A safety razor blade unit according to claim 1, wherein the first spring elements are distributed along the length of the blade unit.

3. A safety razor blade unit according to claim 1, wherein each first spring element is deformable to exert a substantially constant restoring force on an upper frame as the upper frame is displaced towards the sub-frame.

4. A safety razor blade unit according to claim 1, wherein at least some of the first and second spring elements deform resiliently by buckling.

5. A safety razor blade unit according to claim 1, wherein at least some of the first and second spring elements comprise webs of resiliently flexible material.

6. A safety razor blade unit according to claim 3, wherein at least some of the first spring elements are integral with the upper frame.

7. A safety razor blade unit according to claim 1, wherein at least some of the second spring elements are integral with the sub-frame.

8. A safety razor blade unit according to claim 1, wherein the first and second spring elements are webs of resiliently flexible material, at least a portion of each web lying in parallel planes perpendicular to the length of the blade unit.

9. A safety razor blade unit according to claim 1, wherein an upper frame lies substantially in a first plane, the sub-frame defines a second plane, and the first and second planes diverge in the direction from the front to the rear of the blade unit.

10. A safety razor blade unit according to claim 9, wherein the upper frame is hingedly connected by said hinge to the sub-frame at the front of the support structure.

11. A safety razor blade unit according to claim 10, wherein said hinge is a living hinge.

12. A safety razor blade unit according to claim 1 wherein said hinge is a living hinge.

* * * * *

UNITED STATES PATENT AND TRADEMARK OFFICE

CERTIFICATE OF CORRECTION

PATENT NO. : 7,024,776 B2
APPLICATION NO. : 11/185293
DATED : April 11, 2006
INVENTOR(S) : Kevin J. Wain It is certified that error appears in the above-identified patent and that said Letters Patent is hereby corrected as shown below:

Column 9
Line 50, delete "(support structure)".

Column 10
Line 2, delete "(support structure)".
Line 8, delete "(and)".
Line 9, delete "(,)".
Line 10, delete "(support structure)".
Line 11, delete "(blade assembly)".
Line 13, delete "(support structure)".

Signed and Sealed this

Second Day of January, 2007

JON W. DUDAS
*Director of the United States Patent and Trademark Office*